United States Patent [19]

Sharples

[11] 4,167,955

[45] Sep. 18, 1979

[54] LAYERING A LIQUID SAMPLE ONTO CENTRIFUGE TUBE LIQUID CONTENTS

[75] Inventor: Thomas D. Sharples, Atherton, Calif.

[73] Assignee: Beckman Instruments, Inc., Fullerton, Calif.

[21] Appl. No.: 912,695

[22] Filed: Jun. 5, 1978

[51] Int. Cl.[2] ..... B65B 3/04

[52] U.S. Cl. ..... 141/1; 141/9; 141/114

[58] Field of Search ..... 141/1, 2–5, 141/9, 10–12, 69, 70, 114, 313–317, 31, 8; 23/293 A, 259

[56] References Cited

U.S. PATENT DOCUMENTS

| | | | |
|---|---|---|---|
| 3,243,105 | 3/1966 | Anderson | 233/1 R |
| 3,519,400 | 7/1970 | Anderson | 195/1.5 |
| 3,578,240 | 5/1971 | Eberle | 233/26 |
| 3,698,561 | 10/1972 | Babson | 210/445 |
| 3,761,408 | 9/1973 | Lee | 210/78 |
| 3,780,935 | 12/1973 | Lukacs et al. | 233/1 A |
| 3,866,474 | 2/1975 | Hasselmann | 141/114 |
| 3,875,012 | 4/1975 | Dorn et al. | 195/103.5 R |
| 3,973,603 | 8/1976 | Franz | 141/114 |
| 4,015,775 | 4/1977 | Rohde | 233/26 |

*Primary Examiner*—Houston S. Bell

*Attorney, Agent, or Firm*—Robert J. Steinmeyer; Ferd L. Mehlhoff; William H. May

[57] ABSTRACT

A method and apparatus for layering a liquid sample onto a support liquid through a narrow filler passage in a neck protruding from the opening in a substantially closed, flexible centrifuge tube by supporting the tube with its liquid support contents in an upright position, attaching a funnel shaped container to the neck of the tube, applying a squeezing force to the flexible tube to reduce its internal volume thereby forcing the liquid contents into the neck thereof to form a meniscus adjacent the opening of the filler passage, adding a sample liquid into the funnel shaped container above the filler opening and in contact with the meniscus of the support liquid, and releasing the squeezing force from the tube allowing it to return to its normal volume thereby drawing the sample into the tube layered on top of the support liquid.

7 Claims, 4 Drawing Figures

LAYERING A LIQUID SAMPLE ONTO CENTRIFUGE TUBE LIQUID CONTENTS

BACKGROUND OF THE INVENTION

The present invention is directed to the layering of a liquid sample onto a support liquid, such as a gradient solution in a centrifuge tube and, more particularly, to the layering of a liquid sample through a narrow filler passage in an elongated neck protruding from the small access opening in a substantially closed centrifuge tube.

The typical centrifuge tube has a generally uniform cylindrical shape with one end closed and the other end being completely open to receive the fluid sample to be subjected to centrifugation. In a conventional open top tube, after the density gradient has been formed in the tube, it is relatively easy to layer the sample onto the top surface of the gradient by feeding it through a syringe against the inside of the tube just above the top of the gradient. Thus, the sample more or less spreads across the top surface of the gradient, essentially floating there until the centrifuge run begins. Generally, the gradient and sample are in aqueous solution or suspension and are, therefore, miscible. The lower the density difference, the more likely that the sample addition will stir and disturb the gradient. After the sample is introduced into the conventional tube, a tube cap is carefully attached across the open top and secured without disturbing the gradient or the sample and then the tube is placed in a suitable centrifuge for centrifugation.

In a recent development, Steven T. Nielsen developed a new type of centrifuge tube, which makes sealing of the tube and support thereof within a centrifuge much simpler and more reliable. A U.S. patent application Ser. No. 912,698 assigned to Beckman Instruments, Inc., the assignee of the present invention, has been filed concurrently with the present application on the substantially closed tube developed by Nielsen. The invention of the said Steven T. Nielsen was made prior to the present invention and nothing is herein claimed as my invention that is shown or described in the Nielsen application, which is to be regarded as prior art with respect to this application.

While the Nielsen centrifuge tube is substantially closed and may be sealed against the hydrostatic forces during centrifugation, it does not lend itself to the standard technique of layering a sample onto the surface of the supporting gradient. The Nielsen tube is a substantially closed cylindrically shaped tube having a small access or filler opening in one end thereof. Protruding from the opening is a neck or stem enclosing a filler passage through which liquid is inserted into the tube. In a preferred form, the Nielsen centrifuge tube is in the general shape of a "hot dog" with a narrow stem or neck protruding therefrom. The neck or stem is usually centered in the end of the tube and is elongated to the extent that it makes it extremely inconvenient, if not impossible, to layer the sample in the usual manner onto a supporting gradient. Because the tube material is more or less hydrophobic, it is impractical to feed the sample against the inside of the tube neck with the expectation that it will flow by surface tension down the neck and across the underside of the tube shoulder and spread smoothly across the top of the gradient.

SUMMARY OF THE INVENTION

The present invention comprises a simple and highly convenient method for layering a liquid sample onto a support liquid in a substantially closed centrifuge tube having a filler passage formed in a narrow neck or stem protruding from the small access opening in the tube and to apparatus for performing such layering operation. In layering the sample, the tube with its support liquid is supported in an upright position and a funnel-shaped container is attached to the neck of the centrifuge tube, the opening of the container being defined by a stem closely fitting the circumference of the neck of the tube. The tube is then depressed or squeezed to reduce the internal volume thereof, thereby displacing the support liquid from the tube and forcing it into the neck of the tube so that it forms a meniscus adjacent the opening of the filler passage. While the centrifuge tube is squeezed or depressed, a sample liquid is inserted into the funnel shaped container above the opening to the filler passage so that it contacts the meniscus of the support liquid. On removing the squeezing force from the tube, the tube returns to its normal volume, thereby drawing the sample liquid into the centrifuge tube layered on top of the support liquid.

The above-described process for adding a sample to a Nielsen-type tube provides an even more gentle layering technique, requiring less skill than that required for conventional tubes.

While it is quite clear that the gradient may be moved by gently squeezing the tube by hand with no other aid than the funnel, a proposed mechanical apparatus is hereinafter illustrated for more precisely producing the squeezing action.

DETAILED DESCRIPTION OF THE INVENTION

Figure 1:
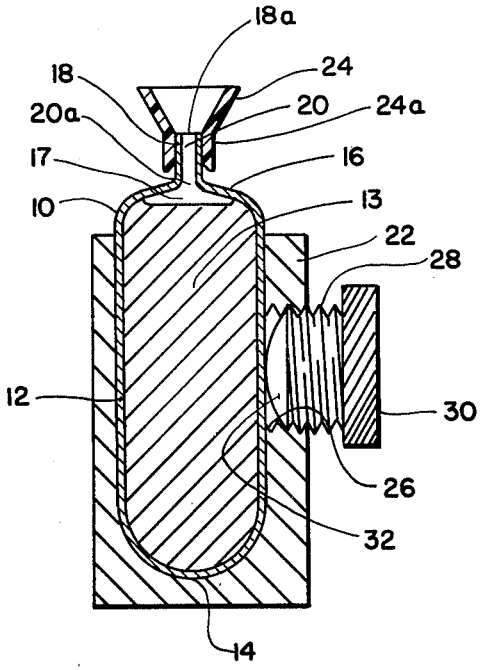
FIG. 1 is a sectional view of a substantially closed centrifuge tube incorporating a funnel shaped container on the protruding neck thereof and illustrating a supporting base for applying a squeezing pressure against the side of the tube.

Referring now to the drawings, there is shown in FIG. 1 a substantially closed centrifuge tube 10 of the type developed and disclosed in the aforesaid Steven T. Nielsen patent application Ser. No. 912,698. The preferred embodiment of the tube has a cylindrical central portion 12, a generally semi-spherical bottom portion 14 and a substantially closed top 16 of generally spherical shape. Protruding from the top 16 is a neck or stem 18 forming a filler passage 20, which connects with the access opening or fill port **20*a* of the tube. Preferably, the top 16, bottom portion 14 and neck 18 are integrally formed with the cylindrical central portion 12. The tube 10 may be easily produced by an extrusion blow-molding process from a fusible plastic material, such as polyallomer. Such plastic material forms a flexible tube which can be depressed to reduce its internal volume by merely hand pressure or by pressure from a suitable mechanical apparatus. The tube of FIG. 1 is shown with typical contents consisting of a density gradient solution 13 gradually increasing from a high density solution at the bottom of the tube to a lower density solution at the top thereof. When the tube is in its relaxed position as shown in FIG. 1, there is space 17 for a sample above the gradient solution 13**.

In FIG. 1, the tube 10 is shown supported in a base or close-fitting holder 22 having a cavity conforming substantially to the shape of the lower portion of the centrifuge tube. The holder 22 may support a single tube or may be adapted to support many tubes substantially in the position shown in FIG. 1.

A funnel-shaped container member 24 is positioned over the neck 18 of the tube with the stem 24*a* of the funnel member closely fitting the circumference of the neck 18. The neck 18 is inserted into the funnel shaped container in a manner so that it does not emerge above the juncture of the stem portion and the funnel-shaped portion of the container so that no space is provided within the funnel-shaped container along the side of the neck or below the opening 18*a* of the neck. Preferably, the funnel-shaped container is formed of an unfilled vinyl plastisol material which is highly flexible and may be somewhat elastomeric so that it may be readily expanded but resumes its shape upon release of the expanding force. The stem 24*a* must fit fairly tightly around the neck 18 of the tube so that any sample added thereto will not leak past the opening 18*a* leading to the passage 20.

The holder 4 is provided with a threaded hole 26 into which there is positioned a threaded plug 28 having a knurled knob 30. Preferably the hole in the support 22 has a righthand thread so that the plug 28 threads into the hole on clockwise rotation. On the inner end of the threaded plug is a radius or oval tip 32.

Figure 2:
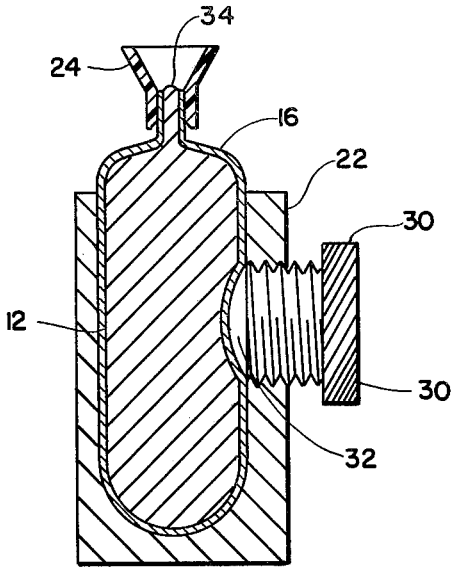
FIG. 2 illustrates the tube and apparatus of FIG. 1 showing one side of the tube depressed to decrease the internal volume of the tube.
Figure 3:
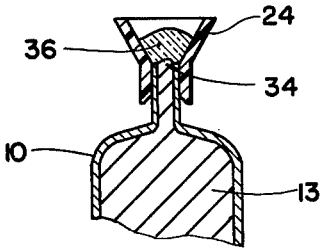
FIG. 3 is a partial sectional view of the tube illustrating the sample added to the container and in contact with the meniscus.

Referring now to FIG. 2, which shows the same details as FIG. 1 except that the knurled knob 30 has been turned a number of turns clockwise to force the oval tip 32 against the sidewall of the tube. By pressing or squeezing against the sidewall of the tube, the tube becomes deformed and the volume therein is substantially reduced. As the volume of the tube is reduced, the support liquid or gradient 13 is displaced upwardly into the tube neck 18 until it forms a slightly convex meniscus 34 at the top of the tube neck, which is essentially at the bottom of the funnel portion of the container in the region of the juncture of the drain stem and the funnel. After the meniscus has been formed as shown in FIG. 2, the liquid sample 36 is added to the funnel-shaped container 24 with the sample being supported above the meniscus 34, formed at the top of the gradient solution 13. This is shown in FIG. 3.

Figure 4:
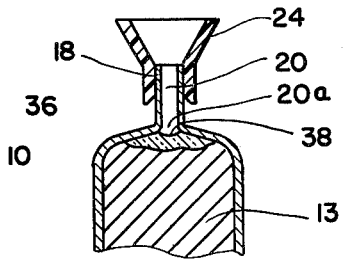
FIG. 4 is a partial sectional view illustrating the tube in its relaxed position with the sample layered on top of the supporting solution.

After the sample has been introduced into the funnel-shaped container, the squeezing or depressing pressure is released by turning the knob 30 counterclockwise, moving the threaded plug outwardly from the tube support cavity thereby permitting the sidewall of the tube to relax. When the sidewall of the tube is returned to its normal position, the volume of the tube is increased thereby drawing the gradient down the stem with the sample following. In this way the sample is gently layered just below the opening 20*a* leading into the filler passage of the neck. FIG. 4 shows the result of turning the knob counterclockwise, allowing the volume of the tube to increase and gently drawing the sample from the funnel down the neck of the tube. When the tube is returned to its normal volume, the sample is positioned as shown in FIG. 4 with a small void of air just below the opening 20*a* to the filler passage. The tube is now ready for sealing.

It will be understood that the tube may be hand held and gently squeezed to form the meniscus at the top of the filler passage within the funnel shaped container and the sample carefully inserted into the container before releasing the pressure on the tube to gently draw the sample back through the filler passage to layer it on top of the gradient solution 13. It is also clear that a number of alternate mechanical, electromechanical, hydraulic and pneumatic devices may be used to provide the gentle controllable squeeze and relaxation of the depressing force needed for practice of this method.

It should also be understood that the tube neck may be in the shape of a funnel integrally formed with the tube. This funnel would then be cut off or melted off after the sample has been layered into the tube and before the sealing operation.

While in accordance with the patent statutes, there has been shown and described what, at present, is believed to be the preferred embodiment of the invention, it will be obvious to those skilled in the art that various changes and modifications may be made therein without departing from the invention and it is, therefore, the aim of the appended claims to cover all such changes and modifications as must fall within the true spirit and scope of the invention.

What is claimed is:

1. A method of layering a liquid sample onto a support liquid, such as a density gradient solution, in a substantially closed, flexible centrifuge tube having a filler passage through a sealing neck protruding from the access opening in the centrifuge tube, comprising:

supporting said centrifuge tube in an upright position with said support liquid inserted in said centrifuge tube;

attaching a funnel-shaped container to the neck of said centrifuge tube, the opening of said container being defined by a drain stem closely fitting the circumference of said neck;

depressing at least a portion of said centrifuge tube thereby reducing the internal volume thereof and forcing said support liquid into the neck of said centrifuge tube to form a meniscus adjacent the opening of said filler passage in said neck;

while said centrifuge tube is depressed, inserting the sample liquid into the funnel-shaped container above the opening to said filler passage in said neck and in contact with the meniscus of said support liquid; and removing the depressing force from said tube allowing it to return to its normal volume thereby drawing the sample into the centrifuge tube layered on top of said support liquid.

2. The method defined in claim 1, in which said centrifuge tube is depressed by a force exerted against the sidewall thereof.

3. The method defined in claim 1 in which the funnel-shaped container is attached to the neck of said tube with the neck protruding into said drain stem to a point substantially adjacent the juncture of said drain stem and the funnel-shaped portion of said container.

4. Apparatus for layering a liquid sample onto a support liquid, such as a density gradient solution, in a substantially closed, flexible centrifuge tube having a filler passage through a narrow sealing neck protruding from the access opening in the centrifuge tube, comprising:

support means having a tube-shaped cavity for holding the centrifuge tube in an upright position with the support liquid within the tube;

a funnel-shaped container positioned above said tube and having a drain stem secured around said neck of said tube;

tube depressing means for depressing a portion of the sidewall of said centrifuge tube thereby reducing the internal volume thereof forcing said support liquid into said neck of said tube to form a meniscus adjacent the opening of said filler passage in said neck so that a liquid sample may be deposited within said funnel-shaped container in contact with said meniscus; and means for releasing said tube depressing means returning said tube to its original volume and causing said sample to be gently drawn through said filler passage into the top of said tube and layered on said support liquid.

5. The apparatus defined in claim 4 in which there is provided in said support means a threaded hole communicating with said tube-shaped cavity and there is positioned within said threaded opening a threaded plug having an inner end surface adapted to be moved against the sidewall of said centrifuge tube in said cavity to depress said sidewall causing a reduction in the volume of said centrifuge tube.

6. The apparatus defined in claim 4 in which said funnel-shaped container includes a drain stem of elastomeric material permitting it to be expanded slightly to fit said filler neck protruding from said tube to produce a tight seal around said neck.

7. The apparatus defined in claim 6 in which said funnel-shaped container is formed of an unfilled vinyl plastisol material.

* * * * *